US005272888A

United States Patent [19]

Fisher et al.

[11] Patent Number: 5,272,888

[45] Date of Patent: Dec. 28, 1993

[54] TOP MOUNT REFRIGERATOR WITH EXTERIOR ICE SERVICE

[75] Inventors: Michael H. Fisher, Princeton; Brian P. Kelley, Ohio Township, Warrick County; Gregory G. Hortin, Center Township, Vanderburgh County, all of Ind.

[73] Assignee: Whirlpool Corporation, Benton Harbor, Mich.

[21] Appl. No.: 866

[22] Filed: Jan. 5, 1993

[51] Int. Cl.[5] ..... F25C 5/18

[52] U.S. Cl. ..... 62/344; 62/441; 222/146.6; 312/404

[58] Field of Search ..... 62/344, 441, 447; 248/200; 312/401, 404; 222/146.6

[56] References Cited

U.S. PATENT DOCUMENTS

| | | | |
|---|---|---|---|
| 2,133,959 | 10/1938 | Buchanan | 62/447 X |
| 2,548,022 | 4/1951 | Hirsch | 222/196 |
| 2,968,168 | 1/1961 | Lippincott | 62/344 |
| 3,201,019 | 8/1965 | Goreham | 226/9 |
| 3,537,132 | 11/1970 | Alvarez | 62/344 X |
| 3,640,088 | 2/1972 | Jacobus et al. | 62/320 |
| 3,789,620 | 2/1974 | Benasutti et al. | 62/344 |
| 4,220,266 | 9/1980 | Braden et al. | 62/344 X |
| 4,227,383 | 10/1980 | Howay | 62/344 |
| 4,285,212 | 8/1981 | Prada | 62/344 |
| 4,333,588 | 6/1982 | Schreck et al. | 222/164 |
| 4,368,622 | 1/1983 | Brooks | 62/447 X |
| 4,555,049 | 11/1985 | Mawby et al. | 222/517 |
| 5,029,737 | 7/1991 | Yamamoto | 222/526 |
| 5,037,004 | 8/1991 | Katz et al. | 222/146.6 |

*Primary Examiner*—William E. Tapoicai

*Attorney, Agent, or Firm*—Thomas J. Roth; Stephen D. Krefman; Thomas E. Turcotte

[57] ABSTRACT

An ice storage and delivery system is provided for a refrigeration apparatus including a refrigerated compartment housing an ice making apparatus and a door providing selective access to the compartment and including a dispenser for delivering formed ice bodies. The system includes an ice container assembly in the refrigerated compartment having a container for storing ice bodies and an auger for conveying ice bodies from the container to a downwardly facing discharge opening. A platform rests on a shelf in the compartment below the ice making apparatus. The platform includes support means for supporting the container assembly below the ice making apparatus and an ice chute for delivering ice bodies from the container discharge opening to the dispenser. A drive motor is mounted to the platform and is operatively associated with the wire auger for driving the wire auger.

18 Claims, 3 Drawing Sheets

TOP MOUNT REFRIGERATOR WITH EXTERIOR ICE SERVICE

FIELD OF THE INVENTION

This invention relates to a refrigeration apparatus including an automatic ice maker and, more particularly, to a top mount refrigerator/freezer with exterior ice service.

BACKGROUND OF THE INVENTION

A typical household refrigeration apparatus comprises a refrigerator compartment and a freezer compartment. The freezer compartment often includes an automatic ice making apparatus. For convenience, such refrigeration apparatus may include a through-the-door ice dispensing apparatus which can provide for the dispensing of both whole, or cubed, ice or crushed ice. The term "cubed ice" can refer to crescent-shaped ice bodies as well as any other shape. It is not crushed or otherwise broken up into small irregular shaped pieces.

Usually, a through-the-door ice dispensing apparatus is provided in a side-by-side refrigeration apparatus. An ice container assembly in the freezer compartment has a container for storing ice cubes and means for conveying ice cubes from the container to a downwardly facing discharge opening. The ice dispensing apparatus includes a chute providing a passageway through the door which opens into a dispenser opening for delivering ice when an ice lever is actuated to request delivery of ice cubes or crushed ice.

In addition to side-by-side refrigeration apparatus, there is a desire to provide automatic through-the-door dispensing in a top mount refrigeration apparatus, i.e., a refrigerator/freezer having a freezer compartment above a fresh food compartment separated by a separator wall. However, the freezer compartment is generally not of sufficient height whereby an ice container assembly could be mounted relative to a dispensing apparatus in the freezer door for dispensing of ice. Moreover, the height of the freezer door is higher than desirable for positioning an ice dispensing apparatus.

To include a through-the-door ice dispensing apparatus in a top mount refrigerator, it is therefore desirable to provide the dispenser housing in the fresh food compartment door. Doing so requires that a passage be provided through the separator wall for delivering ice bodies from the ice container assembly to the dispensing apparatus. Doing so is problematic, as it is necessary to prevent flow of air between the freezer compartment and fresh food compartment.

In including a through-the-door ice dispensing apparatus in a fresh food compartment, a desire has been expressed to have the same mounted at the right side of the door. However, most conventional ice making apparatus are designed to be mounted on the left side wall of the freezer compartment. For economies of scale, it is advantageous to mount all ice making apparatus in the same orientation, rather than providing distinct ice making apparatus for left side mounting or right side mounting.

Finally, with side-by-side refrigeration apparatus, the ice container assembly is typically mounted to the side wall of the freezer compartment. With a top mount refrigerator, it is desirable that the ice container assembly be mounted and supported on the bottom wall of the freezer compartment, i.e., the top surface of the separator wall, which also serves as a shelf for storing food items.

The present invention is intended to overcome one or more of the problems discussed above.

SUMMARY OF THE INVENTION

In accordance with the invention, a top mount refrigeration apparatus is disclosed with a through-the-door ice dispenser in a fresh food compartment door.

Broadly, there is disclosed herein an ice storage and delivery system in a refrigeration apparatus including a refrigerated compartment housing an ice making apparatus and a door providing selective access to the compartment and including a dispenser for delivering formed ice bodies. The system includes an ice container assembly in the refrigerated compartment having a container for storing ice bodies and an auger for conveying ice bodies from the container to a downwardly facing discharge opening. A platform rests on a shelf in the compartment below the ice making apparatus. The platform includes support means for supporting the container assembly below the ice making apparatus and an ice chute for delivering ice bodies from the container discharge opening to the dispenser. Drive means are mounted to the platform and are operatively associated with the wire auger for driving the wire auger.

It is a feature of the invention that the platform is of molded plastic construction.

It is another feature of the invention to provide interlock means operatively associated with the container assembly and the platform for preventing relative movement between the platform and the container during operation of the drive means.

It is another feature of the invention that the interlock means comprises a downwardly extending post on the container received in an opening in the platform support means.

It is a further feature of the invention that the container contains a partial cylindrical bottom wall and the support means comprises a cradle complementary to the bottom wall.

In accordance with another aspect of the invention, the refrigeration apparatus includes a refrigerated freezer compartment housing an ice making apparatus, a fresh food compartment below the freezer compartment separated by a separator wall, and a door providing selective access to the fresh food compartment and including a dispenser for delivering formed ice bodies. An ice container assembly in the freezer compartment has a container for storing ice bodies and an auger conveying ice bodies from the container to a downwardly facing discharge opening. A platform rests on the separator wall in the freezer compartment below the ice making apparatus. The platform includes support means for supporting the container assembly below the ice making apparatus and an ice chute extending through an opening in the separator wall for delivering ice bodies from the container discharge opening to the dispenser. Drive means are mounted to the platform and are operatively associated with the wire auger for driving the wire auger.

It is a feature of the invention to provide an ice chute door pivotally connected to the platform across the chute to restrict air flow from the freezer compartment to the fresh food compartment in the absence of ice bodies being conveyed to the dispenser.

It is another feature of the invention that the ice chute door is gravity biased to a normally, closed position.

There is disclosed in accordance with yet another aspect of the invention an ice dispensing system in a refrigeration apparatus including a cabinet defining a refrigerated compartment having connected opposite left and right side walls, a top wall, a bottom wall and a rear wall in a parallelepiped configuration defining a refrigerated space and a door pivotally mounted to the cabinet providing selective access to the space. The system comprises a vertical support wall mounted in the space between the top and bottom walls intermediate the left and right side walls. An ice making apparatus is mounted to the support wall and disposed between the support wall and the right side wall. An ice container assembly in the space is below the ice making apparatus having a container storing ice bodies and an auger for conveying ice bodies from the conveyer to a downwardly facing discharge opening. Ice dispenser means are mounted to the door at a right side thereof for delivering formed ice bodies from the discharge opening to an external dispensing space.

It is a feature of the invention that the support wall is a generally planar steel wall.

It is another feature of the invention that the support wall is restrained at its top by studs extending downwardly from the top wall to openings in a flange of the support wall.

It is a further feature of the invention that the support wall includes hook means for supporting one end of a shelf, another end of the shelf being secured to the left side wall.

Further features and advantages of the invention will readily be apparent from the specification and from the drawings.

DESCRIPTION OF THE INVENTION

Figure 1:
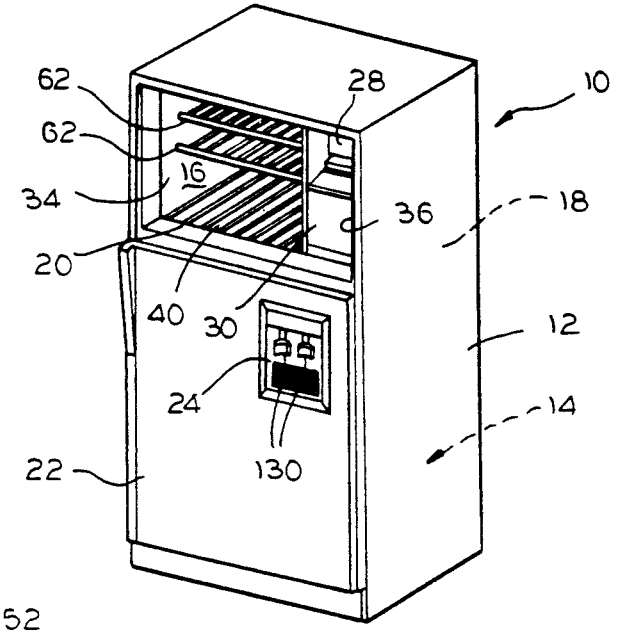
FIG. 1 is a front perspective view of a refrigeration apparatus, with a freezer door removed, including an ice dispensing system according to the invention.
Figure 2:
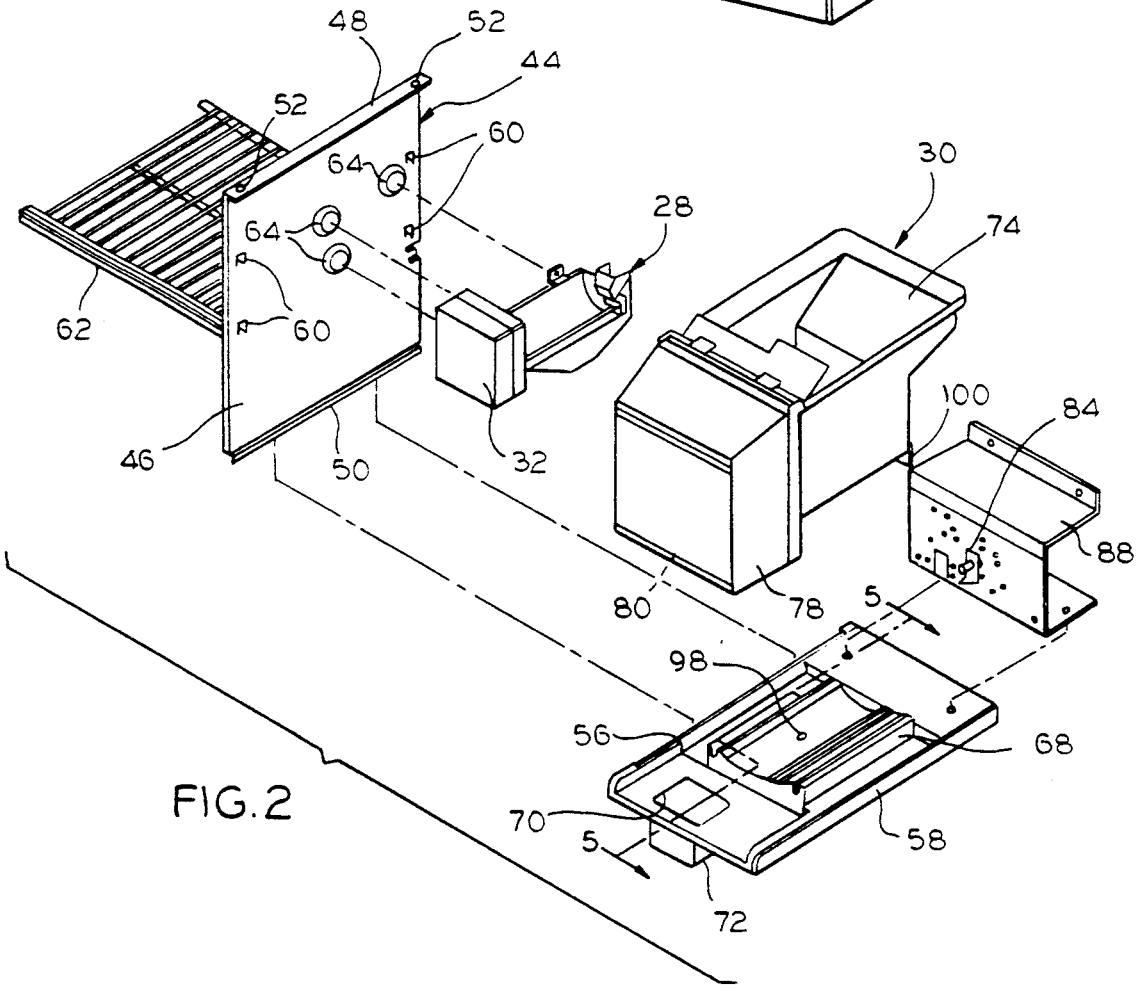
FIG. 2 is an exploded, perspective view of the components of the ice dispensing system of FIG. 1 that are contained in the freezer compartment.
Figure 3:
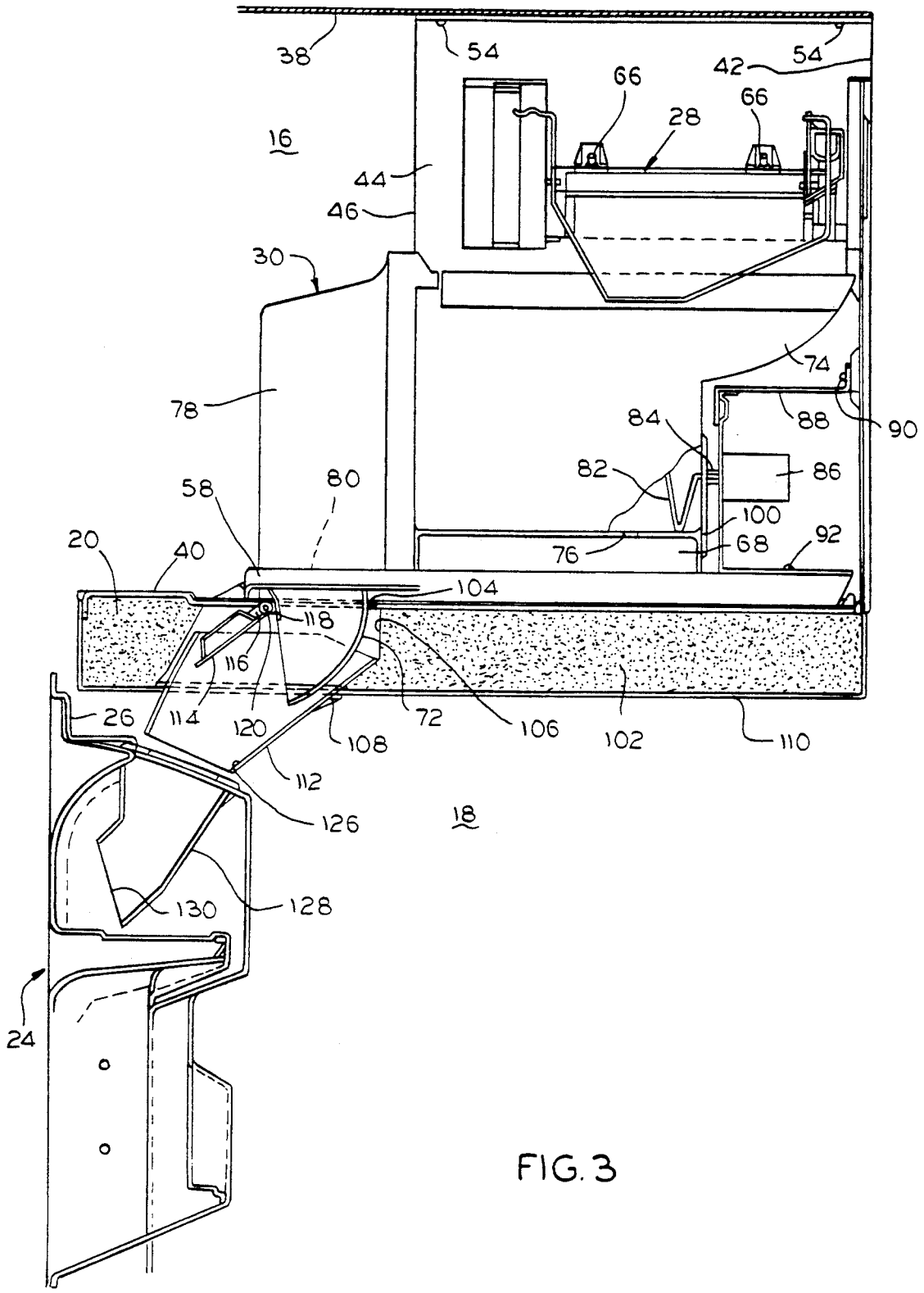
FIG. 3 is a diagrammatic illustration showing the relationship among components in the ice dispensing system of the apparatus of FIG. 1.

With reference to FIG. 1, a refrigeration apparatus 10, comprising a top mount refrigerator/freezer, includes a cabinet 12 having a storage space 14. Particularly, the storage space 14 comprises a below-freezing, or freezer, compartment 16, and an above-freezing, or fresh food, refrigerator compartment 18. The compartments 16 and 18 are separated by an insulated separator wall 20, see also FIG. 3. Access to the fresh food compartment is had through a refrigerator door 22 hingedly mounted to the cabinet 12 as is well known. Access to the freezer compartment is had through a freezer door (not shown), also hingedly mounted to the cabinet 12.

The refrigerator door 22 is provided with a through-the-door ice dispensing apparatus 24. The dispensing apparatus 24 is partially contained within a housing 26, see also FIG. 3, suitably mounted in the refrigerator door 22.

The freezer compartment 16 houses a conventional ice body making apparatus 28 which delivers formed ice bodies into a subjacent ice container assembly 30. The ice making apparatus 28 may be of any known form, such as shown in Chesnut et al., U.S. Pat. No. 4,756,165, owned by the assignee of the present invention. Particularly, such an ice making apparatus 28 is designed to be mounted to a left side wall of a freezer compartment, with a control panel 32 providing front access. In accordance with the invention, the ice ,making apparatus 28 is mounted in the right side of the freezer compartment 16. The freezer compartment 16 includes connected opposite left and right side walls, 34 and 36, respectively, a top wall 38, a bottom wall 40, comprising the top of the separator wall 20, and a rear wall 42 in a parallelepiped configuration normally closed by a freezer door (not shown).

In accordance with the invention, a conventional ice making apparatus 28 adapted to be mounted to the left side wall 34 is instead mounted to a vertical support wall 44 mounted in the freezer compartment 16 between the top and bottom walls 38 and 40, respectively, and intermediate the left and right side walls 34 and 36, respectively. The support wall 44 includes a generally planar wall 46 turned to provide a top flange 48 and having a bottom flange 50. The top flange 48 includes spaced openings 52 receiving posts 54, see FIG. 3, extending downwardly from the top wall 38. The bottom flange 50 is received in a track 56 provided in a platform assembly 58, described more specifically below.

The support wall 44 includes a plurality of formed in hooks 60 to support freezer shelves 62 extending from the hooks 60 to suitable structure in the left side wall 34. The support wall 44 also includes sumped areas 64 mounting ice maker support anchors 66 for securing the ice making apparatus 28 thereto so that it is disposed between the support wall 44 and the right side wall 36. Thus, the ice making apparatus 28 is suitably installed in the rightmost portion of the freezer compartment 16.

Figure 5:
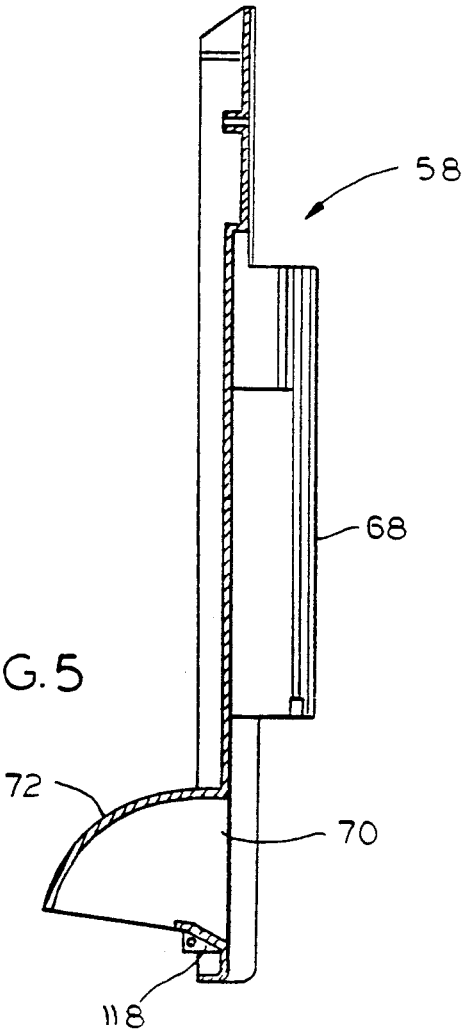
FIG. 5 is a sectional view taken along the line 5—5 of FIG. 2.
Figure 7:
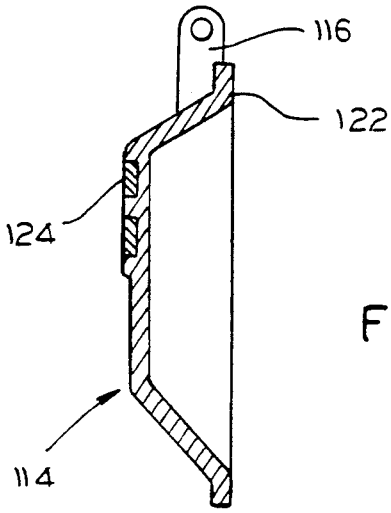
FIG. 7 is a sectional view taken along the line 7—7 of FIG. 6.

As is well known, the freezer compartment bottom wall 40 also serves as a shelf for supporting goods stored therein. The platform assembly 58 rests on the bottom wall 40 in the freezer compartment 16 below the ice making apparatus 28. With reference also to FIG. 5, the platform 58 is of one-piece construction and is injection molded of ABS plastic. The platform 58, in addition to the track 56, includes a cradle portion 68 defining a support for the ice container assembly 30. Forwardly of the cradle portion 68 there is provided an opening 70 communicating to a chute 72.

Figure 4:
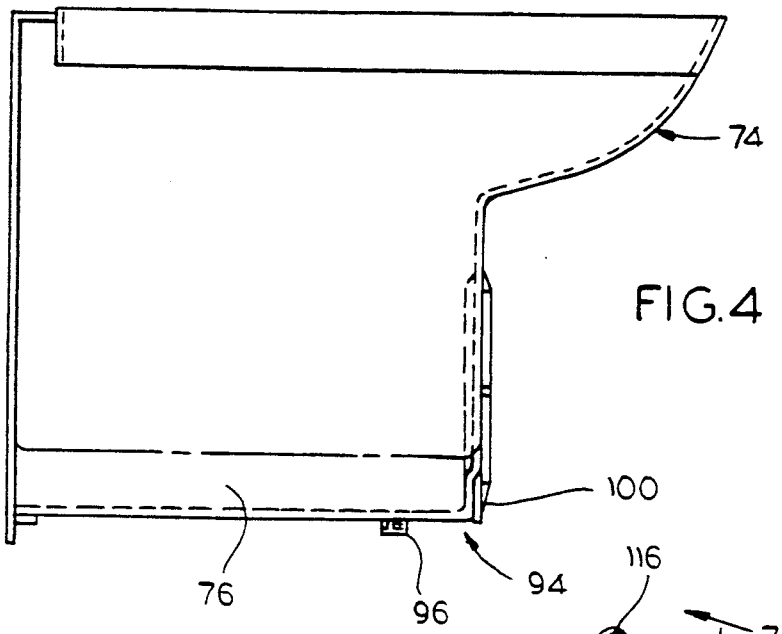
FIG. 4 is a side view of the ice container assembly of FIG. 1.

The ice container assembly 30 comprises a container 74, see also FIG. 4, for storing formed ice bodies. The container 74 has a partial cylindrical bottom wall 76. The platform cradle portion 68 is complementary to the bottom wall 76 for properly supporting the same. A housing 78 is secured at the front of the container 74 and includes a downwardly facing discharge opening 80 for delivering whole or crushed ice bodies. Particularly, the discharge opening is positioned so that with the ice container 74 mounted on the platform cradle portion 68, the discharge opening 80 is directly above the platform opening 70. The ice container assembly 30 includes an ice conveyor in the form of a wire auger 82 for conveying ice bodies to the front housing 78 for dispensing. A rear end of the wire auger 82 is received by an auger coupler 84 operatively connected to an output shaft of a drive motor 86. Particularly, the drive motor 86 is secured to an auger motor bracket 88 which is secured to the rear wall 42 using fasteners 90 and to the platform 58 using fasteners 92, see FIG. 3. Thus, the bracket 88 secures the platform 58, and thus also the support wall 44, in the freezer compartment 16. The wire auger 80 is effectively coupled to the auger coupler 84 incident to the ice container assembly 30 being properly positioned on the platform 58.

As is apparent, rotation of the wire auger 82 produces forces on the ice container assembly 30 which might cause it to move away from the motor 86 or to itself rotate, particularly if a jam-up occurs. However, the ice container assembly is restrained from such movement by the use of a two-part interlock structure 94. Particularly, the interlock structure 94 includes a downwardly extending post 96 on the container bottom wall 76 received in an opening 98 in the platform cradle portion 58. Additionally, a downwardly extending rear wall 100 abuts the platform cradle portion 68, see FIG. 3, to restrain horizontal forward movement of the ice container assembly 30.

Figure 6:
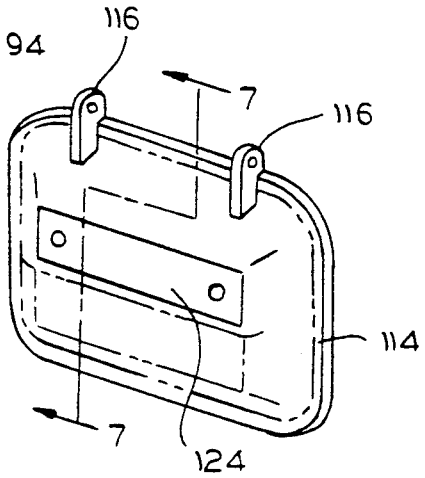
FIG. 6 is a perspective view of an ice chute door.

The separator wall 20 is filled with a suitable insulation body 102 for minimizing heat transfer between the compartments 16 and 18. The freezer bottom wall 40 includes an opening 104 for receiving the platform chute 72. The insulation body 102 includes a similar opening 106 extending down to an opening 108 in a top wall 110 of the refrigerator compartment 18. An ice chute 112 snaps into the refrigerator top wall 110 and extends into the insulation opening 106 so that it extends below the freezer wall opening 104. As a result, the platform chute 72 extends downwardly into the separator chute 112. To minimize heat transfer between the wall openings 104 and 108, the platform 58 is positioned so that it overlays the opening 104. Moreover, a flapper door 114, see FIG. 6, includes hinges 116 hingedly mounted to platform hinges 118 above the platform chute 72, as at 120. The flapper 114 includes a flange area 122 which bears on the chute 72 to close the same. A counterweight 124 is molded into the flapper door 114 to gravity bias the same to a closed position in the absence of ice bodies passing through the chute 104.

The separator chute 112 includes a discharge opening 126 immediately above an inner door chute 128 that leads to the dispenser housing 26.

Although not shown, the ice dispensing apparatus 24 includes suitable actuating structure controlled by levers 130, see FIG. 1, for selecting dispensing of ice or water, as is well known. When one of the levers 130 associated with ice is pressed, then suitable circuitry (not shown) is operated to energize the motor 86 to turn the auger wire 82. Rotation of the auger wire 82 conveys ice bodies forwardly to the container assembly discharge opening 80 through which ice bodies are dispensed into the chute 72, causing the flapper door 114 to open. The ice bodies then fall through the partition chute 112 into the dispenser chute 128, where they fall through a dispenser opening 130 to a subjacent container.

As is apparent, the platform 58 could also be used for shelf mounting the container assembly 30 on any shelf in freezer compartment of any known form. Similarly, the support wall 44 can be used for mounting a conventional ice making apparatus 28 to a right side of a freezer compartment of any known form provided with exterior door service on the right side.

Thus, in accordance with the invention, there is disclosed a top mount refrigerator/freezer with exterior ice service provided on a right-hand side of the refrigerator door. Further, there is disclosed a platform resting on the separator wall in the freezer compartment for supporting an ice container assembly and having an ice chute extending through an opening in the separator wall for delivering ice bodies from the container discharge opening to an ice dispenser.

We claim:

1. In a refrigeration apparatus including a refrigerated compartment housing an ice making apparatus and a door providing selective access to said compartment and including a dispenser for delivering formed ice bodies, an ice storage and delivering system comprising:

an ice container assembly in said refrigerated compartment having a container for storing ice bodies and an auger for conveying ice bodies from said container to a downwardly facing discharge opening;

a platform resting on a shelf in said compartment below said ice making apparatus, said platform including support means for supporting said container assembly below said ice making apparatus and an ice chute for delivering ice bodies from said container discharge opening to said dispenser; and drive means operatively associated with said auger for driving said auger.

2. The ice storage and delivery system of claim 1 wherein said platform is of molded plastic construction.

3. The ice storage and delivery system of claim 1 further comprising interlock means operatively associated with said container assembly and said platform for preventing relative movement between said platform and said container during operation of said drive means.

4. The ice storage and delivery system of claim 3 wherein said interlock means comprises a downwardly extending post on said container received in an opening in said platform support means.

5. The ice storage and delivery system of claim 1 wherein said container includes a partial cylindrical bottom wall and said support means comprises a cradle complementary to said bottom wall.

6. In a refrigeration apparatus including a refrigerated freezer compartment housing an ice making apparatus, a fresh food compartment below said freezer compartment separated by a separator wall, and a door providing selective access to said fresh food compartment and including a dispenser for delivering formed ice bodies, an ice storage and delivering system comprising:

an ice container assembly in said freezer compartment having a container for storing ice, bodies and an auger for conveying ice bodies from said container to a downwardly facing discharge opening;

a platform resting on said separator wall in said freezer compartment below said ice making apparatus, said platform including support means for supporting said container assembly below said ice making apparatus and an ice chute extending through an opening in said separator wall for delivering ice bodies from said container discharge opening to said dispenser; and drive means mounted to said platform and operatively associated with said auger for driving said auger.

7. The ice storage and delivery system of claim 6 wherein said platform is of molded plastic construction.

8. The ice storage and delivery system of claim 6 further comprising interlock means operatively associated with said container assembly and said platform for preventing relative movement between said platform and said container during operation of said drive means.

9. The ice storage and delivery system of claim 8 wherein said interlock means comprises a downwardly extending post on said container received in an opening in said platform support means.

10. The ice storage and delivery system of claim 6 wherein said container includes a partial cylindrical bottom wall and said support means comprises a cradle complementary to said bottom wall.

11. The ice storage and delivery system of claim 6 further comprising an ice chute door pivotally connected to said platform across said chute to restrict air flow from said freezer compartment to said fresh food compartment, in the absence of ice bodies being conveyed to said dispenser.

12. The ice storage and delivery system of claim 11 wherein said ice chute door is gravity biased to a normally closed position.

13. In a refrigeration apparatus including a cabinet defining a refrigerated compartment having connected opposite left and right side walls, a top wall, a bottom wall and a rear wall in a parallelepiped configuration defining a refrigerated space and a door pivotally mounted to said cabinet providing selective access to said space, an ice dispensing system comprising:

a vertical support wall mounted in said space between and supported by said top and bottom walls intermediate said left and right side walls;

an ice making apparatus mounted to said support wall and disposed between said support wall and said right side wall;

an ice container assembly in said space below said ice making apparatus having a container for storing ice bodies and an auger for conveying ice bodies from said container to a downwardly facing discharge opening; and ice dispenser means mounted to said door at a right side thereof for delivering formed ice bodies from said discharge opening to an external dispensing space 14. The ice dispensing system of claim 13 further comprising a platform resting on a shelf in said space below said ice making apparatus, said platform including support means for supporting said container assembly below said ice making apparatus and an ice chute for delivering ice bodies from said container discharge opening to said dispenser.

15. The ice dispensing system of claim 13 wherein said support wall is a generally planar steel wall.

16. The ice dispensing system of claim 13 wherein said support wall is restrained at its top by studs extending downwardly from said top wall into openings in a flange of said support wall.

17. The ice dispensing system of claim 13 wherein said support wall includes formed in hook means for supporting one end of a shelf, another end of the shelf being secured to the left side wall.

18. In a refrigeration apparatus including a refrigerated freezer compartment having connected opposite left and right side walls a top wall, a bottom wall and a rear wall in a parallelepiped configuration defining a refrigerated space, a fresh food compartment below said freezer compartment separated by a separator wall defining said freezer compartment bottom wall, and a door providing selective access to said fresh food compartment, an ice dispensing system comprising:

a vertical support wall mounted, in said freezer compartment between said top and bottom walls intermediate said left and right side walls;

an ice making apparatus mounted to said support wall and disposed between said support wall and said right side wall;

an ice container assembly in said freezer compartment having a container for storing ice bodies and an auger for conveying ice bodies from said container to a downwardly facing discharge opening;

a platform resting on said separator wall in said freezer compartment below said ice making apparatus, said platform including support means for supporting said container assembly below said ice making apparatus and an ice chute extending through an opening in said separator wall for conveying ice bodies from said discharge opening;

drive means mounted to said platform and operatively associated with said auger for driving said auger; and ice dispenser means mounted to said door at a right side thereof for delivering formed ice bodies from said platform chute to an external dispensing space.

* * * * *